US011400457B2

(12) United States Patent
Ebadian et al.

(10) Patent No.: US 11,400,457 B2
(45) Date of Patent: Aug. 2, 2022

(54) SOLID STATE DRIVE MEDIA DESTROYER

(71) Applicant: Phiston Technologies, Inc., Miramar, FL (US)

(72) Inventors: M. Ali Ebadian, Miramar, FL (US); Raul Travieso, Miami, FL (US)

(73) Assignee: Phiston Technologies, Inc., Miramar, FL (US)

( * ) Notice: Subject to any disclaimer, the term of this patent is extended or adjusted under 35 U.S.C. 154(b) by 0 days.

(21) Appl. No.: 16/405,338

(22) Filed: May 7, 2019

(65) Prior Publication Data

US 2020/0023374 A1 Jan. 23, 2020

Related U.S. Application Data

(63) Continuation-in-part of application No. 16/040,776, filed on Jul. 20, 2018, now abandoned.

(51) Int. Cl.

| | |
|---|---|
| ***B02C 18/14*** | (2006.01) |
| ***B02C 25/00*** | (2006.01) |
| ***B02C 18/24*** | (2006.01) |

(52) U.S. Cl.

CPC ..... *B02C 18/142* (2013.01); *B02C 18/24* (2013.01); *B02C 25/00* (2013.01)

(58) Field of Classification Search

CPC . B02C 19/0025; B02C 19/0062; B02C 18/00; B02C 18/007; B02C 18/16; B02C 2018/0015

USPC ..... 241/30, 14, 236

See application file for complete search history.

(56) References Cited

U.S. PATENT DOCUMENTS

| | | | | |
|---|---|---|---|---|
| 4,507 A | | 5/1846 | Clark | |
| 2,222,073 A | | 11/1940 | Hauge | |
| 2,292,901 A | * | 8/1942 | Schmitz, Jr. | D21B 1/066 241/111 |
| 2,535,714 A | * | 12/1950 | Anderson | A22B 5/205 83/661 |
| 2,646,726 A | * | 7/1953 | Fogg | B42C 5/04 407/34 |
| 2,682,098 A | * | 6/1954 | Wilcox | B23D 61/121 83/848 |
| 2,838,720 A | | 6/1958 | Dostal | |
| 2,962,560 A | | 11/1960 | Folse | |

(Continued)

FOREIGN PATENT DOCUMENTS

KR 10-1715335 * 3/2017

OTHER PUBLICATIONS

Anonymous, "High security data storage media destruction", Phiston Technologies, Inc. corporate marketing literature, (2018).

(Continued)

*Primary Examiner* — Shelley M Self
*Assistant Examiner* — Smith Oberto Bapthelus
(74) *Attorney, Agent, or Firm* — McHale & Slavin, P.A.

(57) ABSTRACT

Disclosed is an apparatus for destroying the operational aspects and electronic media of a Solid State Drive (SSD) yet maintaining the physical shape of the SSD for identification. The apparatus includes a crusher box having counter-rotating rollers that are intermeshed to provide a high speed feed of an SSD wherein teeth formed on the rollers render the electron media non-accessible and impart a distinctive waffle like appearance for ease of identifying destroyed SSD's. A VFD-PID controller is used to vary the speed of an electric motor 50 with the PID having a feedback signal that allows for various target values to be set.

1 Claim, 8 Drawing Sheets

(56) References Cited

U.S. PATENT DOCUMENTS 2,974,695 A * 3/1961 Pfeffer ..... B23D 61/04 83/838
3,169,435 A * 2/1965 Hartger ..... B23D 61/021 407/60
3,226,042 A * 12/1965 Adamski ..... B02C 4/02 241/159
3,321,586 A 5/1967 Krones
3,461,497 A * 8/1969 Winston ..... B29C 48/59 366/82
3,995,768 A 12/1976 Montalbano et al.
4,157,581 A 6/1979 Keiichi et al.
4,161,296 A * 7/1979 Parker ..... B02C 18/148 241/152.2
4,272,032 A 6/1981 Hellberg
4,286,295 A 8/1981 Ipolyi
4,291,618 A 9/1981 Heiser et al.
4,423,460 A 12/1983 Jackson et al.
4,423,844 A * 1/1984 Sours ..... B02C 18/0084 241/236
4,529,134 A * 7/1985 Williams ..... B02C 18/142 241/236
4,551,782 A 11/1985 Seely et al.
4,609,155 A * 9/1986 Garnier ..... B02C 18/24 241/101.2
4,621,299 A 11/1986 Hill
4,625,925 A * 12/1986 Goldhammer ..... B02C 18/0007 241/236
4,639,821 A 1/1987 Littwin et al.
4,661,911 A * 4/1987 Ellery, Sr. ..... B02C 25/00 162/254
4,669,673 A * 6/1987 Lodovico ..... B02C 19/0081 241/158
4,690,340 A * 9/1987 Hatanaka ..... B02C 18/0007 241/236
4,757,419 A 7/1988 Masaki
4,923,126 A * 5/1990 Lodovico ..... B02C 18/182 241/100
5,090,628 A * 2/1992 Porter ..... B23Q 11/0057 241/100
5,110,060 A * 5/1992 Lundquist ..... B02C 18/142 241/158
5,132,860 A 7/1992 Von Stein
5,198,959 A 3/1993 Scholtysik et al.
5,203,513 A 4/1993 Keller et al.
5,292,078 A * 3/1994 Lodovico ..... B02C 19/0081 241/167
5,302,078 A 4/1994 Essick et al.
5,580,009 A * 12/1996 Kennedy ..... B02C 18/142 241/236
5,611,495 A * 3/1997 Williams ..... B02C 18/142 241/236
5,666,413 A 9/1997 Kempf
5,691,873 A 11/1997 Masaki
5,711,492 A 1/1998 Cheladze
5,721,665 A 2/1998 Schultz
5,765,765 A * 6/1998 Tamura ..... B02C 18/142 241/27
5,833,150 A * 11/1998 Koyanagi ..... B02C 13/30 241/27
5,884,855 A 3/1999 Chang
5,904,305 A * 5/1999 Kaczmarek ..... B02C 18/14 241/157
5,927,627 A * 7/1999 Edson ..... B02C 4/08 241/159
5,979,774 A 11/1999 Urushibata
5,985,221 A * 11/1999 Knecht ..... B02C 4/02 423/22
6,202,949 B1 * 3/2001 Hayles, Jr. ..... B02C 13/20 241/188.1
6,259,222 B1 * 7/2001 Kira ..... B02C 25/00 241/35
6,355,140 B1 * 3/2002 Murakami ..... D21F 11/00 162/103
6,439,486 B1 * 8/2002 Nitta ..... B02C 1/04 241/159
6,523,767 B1 2/2003 Ramesohl
6,527,209 B1 * 3/2003 Dorscht ..... B02C 18/142 241/101.2
6,565,026 B1 5/2003 Hall
6,714,398 B2 3/2004 Schultz
6,938,843 B2 * 9/2005 Johansson ..... D21D 1/002 241/21
7,267,146 B2 9/2007 Olofsson
7,267,294 B2 9/2007 Castronovo
7,270,282 B2 9/2007 Castronovo
7,324,321 B2 1/2008 Olliges
7,334,747 B2 2/2008 Castronovo
7,357,340 B2 4/2008 Castronovo
7,424,981 B2 9/2008 Castronovo
7,448,562 B2 11/2008 Castronovo
7,500,625 B2 3/2009 Castronovo
7,852,590 B1 12/2010 Olliges
7,861,956 B2 1/2011 Hiller, Sr.
7,975,950 B2 7/2011 Ebadian et al.
8,025,246 B1 * 9/2011 Brown ..... A47G 29/12 241/100
8,064,183 B2 11/2011 Olliges
8,158,043 B2 * 4/2012 Gibson ..... B29C 43/22 264/156
8,356,764 B2 * 1/2013 Aizenberg ..... B02C 4/08 241/100
8,794,559 B1 8/2014 Olliges et al.
9,079,372 B1 * 7/2015 Hershman ..... B30B 9/3035
9,430,654 B1 * 8/2016 Rajaie ..... B02C 25/00
9,776,192 B2 10/2017 Ebadian et al.
10,071,382 B1 9/2018 Ebadian et al.
2001/0045478 A1 11/2001 Recker et al.
2003/0015818 A1 1/2003 Magvire
2003/0089806 A1 * 5/2003 Galanty ..... B02C 18/0092 241/46.06
2004/0112999 A1 6/2004 Byram et al.
2005/0040263 A1 * 2/2005 Parke ..... B02C 18/142 241/30
2006/0016919 A1 1/2006 Castronovo
2006/0236839 A1 * 10/2006 Munch ..... B23C 5/08 83/875
2006/0243643 A1 * 11/2006 Scott ..... B01D 33/0376 209/309
2007/0075168 A1 4/2007 Rodriguez et al.
2007/0125895 A1 * 6/2007 Chen ..... B02C 18/16 241/236
2008/0147241 A1 * 6/2008 Tsangaris ..... C03B 5/005 700/273
2008/0257993 A1 * 10/2008 Cole ..... B02C 18/0007 241/243
2008/0265073 A1 * 10/2008 Sommer ..... B02C 4/08 241/231
2009/0140086 A1 * 6/2009 Thiel ..... B02C 18/142 241/27
2010/0046318 A1 * 2/2010 Holt ..... A21C 11/20 366/76.2
2010/0201024 A1 * 8/2010 Gibson ..... B29C 43/22 264/156
2010/0276524 A1 * 11/2010 Ebadian ..... B02C 1/005 241/27
2010/0320121 A1 12/2010 Bauman et al.
2011/0272501 A1 * 11/2011 Butler ..... G05B 13/024 241/15
2012/0024992 A1 * 2/2012 Zeeck ..... C10L 5/363 241/25
2012/0276331 A1 * 11/2012 Orr ..... B29C 53/24 428/137
2012/0282436 A1 * 11/2012 Coe ..... B29C 55/18 428/131
2012/0312907 A1 * 12/2012 Gronvall ..... B02C 4/305 241/30
2013/0014965 A1 * 1/2013 Barger ..... A01B 45/026 172/21
2014/0077014 A1 * 3/2014 Cooper ..... A01F 29/005 241/165.5

(56) References Cited

U.S. PATENT DOCUMENTS

| | | | | |
|---|---|---|---|---|
| 2014/0209718 | A1* | 7/2014 | Bevins | B02C 23/10 241/24.11 |
| 2014/0209723 | A1 | 7/2014 | Ebadian et al. | |
| 2014/0299702 | A1 | 10/2014 | Kroell et al. | |
| 2015/0041576 | A1* | 2/2015 | Romanovich | B02C 18/142 241/236 |
| 2015/0059599 | A1* | 3/2015 | Boegli | B31F 1/07 101/23 |
| 2015/0139710 | A1* | 5/2015 | Hasegawa | G03G 21/0094 399/346 |
| 2015/0328642 | A1* | 11/2015 | Shegerian | B02C 18/16 241/30 |
| 2016/0046040 | A1* | 2/2016 | Dahlheimer | B29C 48/92 425/202 |
| 2016/0082443 | A1* | 3/2016 | Nydam | B02C 18/0092 241/46.06 |
| 2017/0008051 | A1* | 1/2017 | Sadat | B09B 3/0075 |
| 2017/0246640 | A1* | 8/2017 | Wagner | B02C 18/142 |
| 2017/0259270 | A1* | 9/2017 | Watkins | B02C 23/32 |

OTHER PUBLICATIONS

Anonymous, "A patented high security optical media destroyer that disintegrates CD's, DVD's, Blu-Ray discs, and magnetic strip cards", Phiston Technologies, Inc., article from Internet: www.phiston.com/mediadice, (2018).

Definition of tang, The Free Dictionary, Farlex.

* cited by examiner 71
76
80
$D_3$
36
16
10
30
12
78
G
5

7.0
$W_2$
16
10
14
18
12
5.5
$W_1$

SOLID STATE DRIVE MEDIA DESTROYER

PRIORITY CLAIM

In accordance with 37 C.F.R. § 1.76, a claim of priority is included in an Application Data Sheet filed concurrently herewith. Accordingly, the present invention claims priority as a continuation-in-part of U.S. patent application Ser. No. 16/040,776, entitled "SOLID STATE DRIVE MEDIA DESTROYER", filed Jul. 20, 2018. The contents of the above referenced application is incorporated herein by reference in its entirety.

FIELD OF INVENTION

The invention relates to the field of electronic memory media destruction and in particular to a solid state drive media destroyer leaving a traceable body.

BACKGROUND OF THE INVENTION

Improperly discarded solid state drives can retain media indefinitely. Electronic media stored on a solid state drive is defined herein as the digital data information stored in memory devices that uses integrated circuit assemblies as memory to store data. It is a common belief that the electronic erasing of a solid state drive (SSD) by demagnetizing permanently destroys all electronic media. However, media deleted from a SSD may be recovered if the electronic erasing was not proper performed, or the equipment used for electronic erasing malfunctions. It has practically a daily occurrence wherein a media organization reports disclosure of confidential media which can easily be caused from an improperly disposed of SSD. Any disclosure of confidential information may cause harm to individuals, businesses and governments.

Confidentiality of electronic remains paramount in modern society. The European Union recently passed the General Media Protection Regulation (GDPR) to reinforce media privacy for citizens and companies. The GDPR includes a process that allows individuals to delete their personal media to prevent harmful hacks. The GDPR also allows for simplified access to an individual's media and notifies individuals if he or she has been hacked. The GDPR spans across Europe but is also included in organizations outside the European Union that process or monitor personal media from the EU or provide goods and services to the EU. It is required for all EU-related organizations to join the GDPR; if they do not they can be fined up to four percent of the company's annual global turnover.

The potential liability and losses from inadvertent disclosures can be devastating to the individual or business. For instance, disclosure of an individual's bank information can wipe out the individual savings and credit rating. While this loss could be financially catastrophic to the individual, such loses are seldom covered by the media unless the individual is a celebrity allowing such crimes to go largely unnoticed.

While there are numerous methods for destroying media, the type of destruction is typically dependent upon the required level of security. In some instances destruction by cutting the SSD into fragments small enough that meaningful media cannot be easily extracted is warranted. Memory media destruction is known in the industry and the Applicant has been awarded patents on various methods for destroying media including U.S. Pat. Nos. 7,975,950; 8,975,950; and 9,776,192.

U.S. Publication (2009/0140086) issued to Thiel discloses the use of a rotatable member 70 secured to a pivot arm 66, and a biasing system 10 connected to the pivot arm 66. A drive gear 36 and idler gear 38 are used with energy from the drive gear 36 approximately evenly split between the idler gear 38 and a second stage gear 47. Thiel relies on spring-loaded counter rotating teeth rollers to puncture Solid State Drives (SSDs). The rotational forces of the rollers slowly push the media through the system while adapting to the media thickness by means of planetary gear-chain, cam linkages, and spring-loaded pistons. The cam motion aspect of the rollers adjusting to the media thickness protects in a punch-press operation.

U.S. Publication (2016/0046040) issued to Dahlheimer relates to plastic strand granulation and more specifically, a method for manufacturing thermoplastic micro-pellets. Dahlheimer apparatus uses dissimilar counter rotating rollers, (a toothed squeezing roller and a plain cylindrical pressure roller), that does not imprint but granulates. Counter rotating rollers are solid cylinders with the toothed roller applying pressure to form plastic strands into granulate cushions for the use of micro-pellet technology.

Fragmental destruction is not necessary in every instance and in many instances the SSD needs to be destroyed but the physical drive maintained in one piece to allow tracking of the destroyed SSD.

What is needed in the industry is a method of destroying SSD's at a high rate of speed while maintaining the body of the SSD to provide physical evidence that SSD has been destroyed.

SUMMARY OF INVENTION

Disclosed is an apparatus for destroying SSD's and maintaining the physical shape of the SSD to provide tangible evidence of the destruction. The apparatus employs a crusher box having a pair of rollers with teeth in a spaced apart position constructed and arranged to penetrate an SSD. The rollers allow for the absolute destruction of the SSD and creates a distinctive pattern on the shell of the SSD. The rollers are shaped to process each SSD at a high rate of speed leaving waffle indentations that are distinctive corrugated penetrations rendering the electronic media stored in the SSD unreadable and non-accessible. The SSD outline remains the same and a majority of any identifiable markings made on the outer surface of the SSD remains legible.

An objective of the invention is to render the electronic media stored on an SSD unusable and irretrievable.

Another objective of the invention is to provide a crusher device employing counter rotating rollers having cylindrical arrays of hardened steel teeth in a spaced apart position to cause media destruction of an SSD yet rending a distinctive waffle pattern to the outer shell of the SSD allowing visual confirmation of destruction.

Still another objective of the invention is to provide adjustable cylindrical rollers to accept and destroy 1.5" to 2.5" SSD's without the need to remove plastic or aluminum casings, or use any special adapter.

Still another objective of the invention is to provide a device capable of rending the electronic media on an SSD unreadable and inaccessible in less than 10 seconds.

Another objective of the invention is to provide an apparatus that can destroy electronic media in SSD's at a rate of 720 per hour, which is about 1 SSD every 5 seconds.

Still another objective of the invention is to employ helically stacked sharp-profile discs (teeth) that operate at a relatively high speed to cut into SSDs producing a waffle pattern effect.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
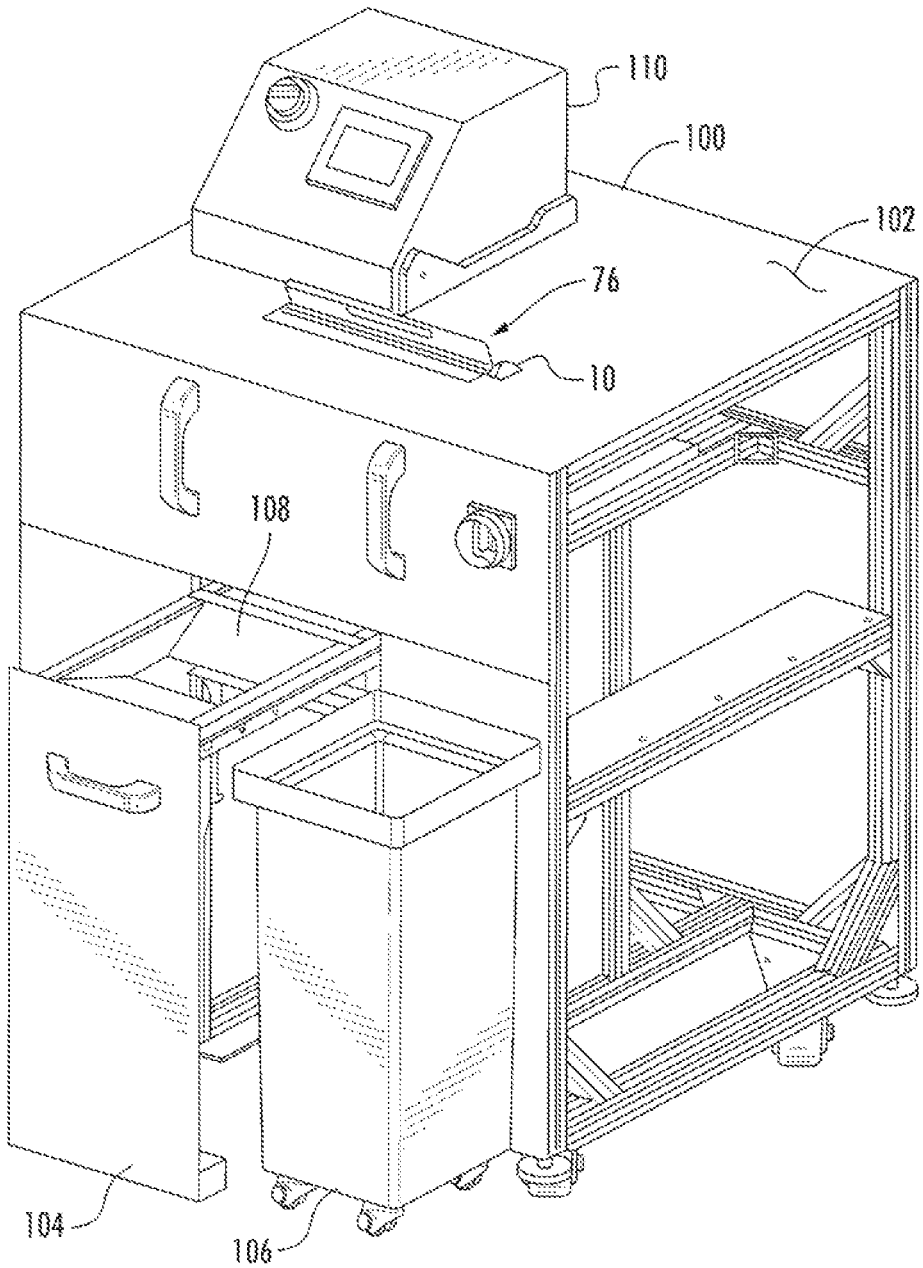
FIG. 1 is a front perspective view of the SSD high speed destroyer of the instant invention.
Figure 2:
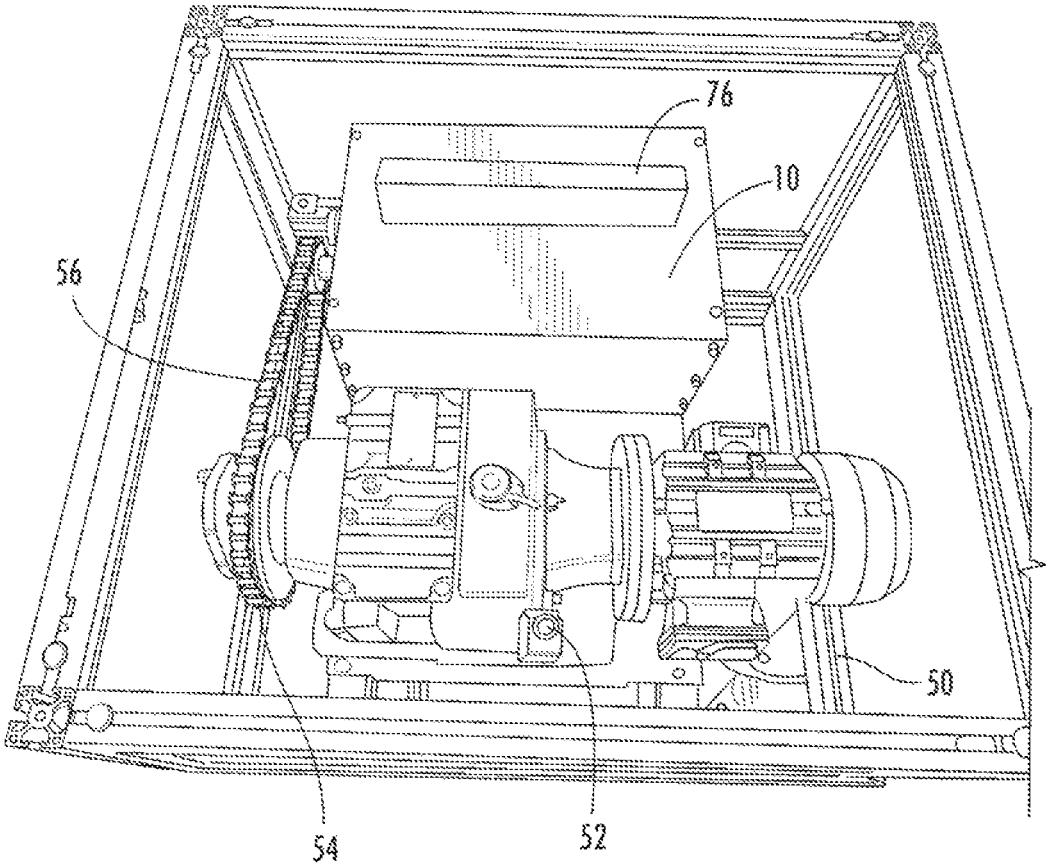
FIG. 2 is a top view depicting the crush box and driver.
Figure 3:
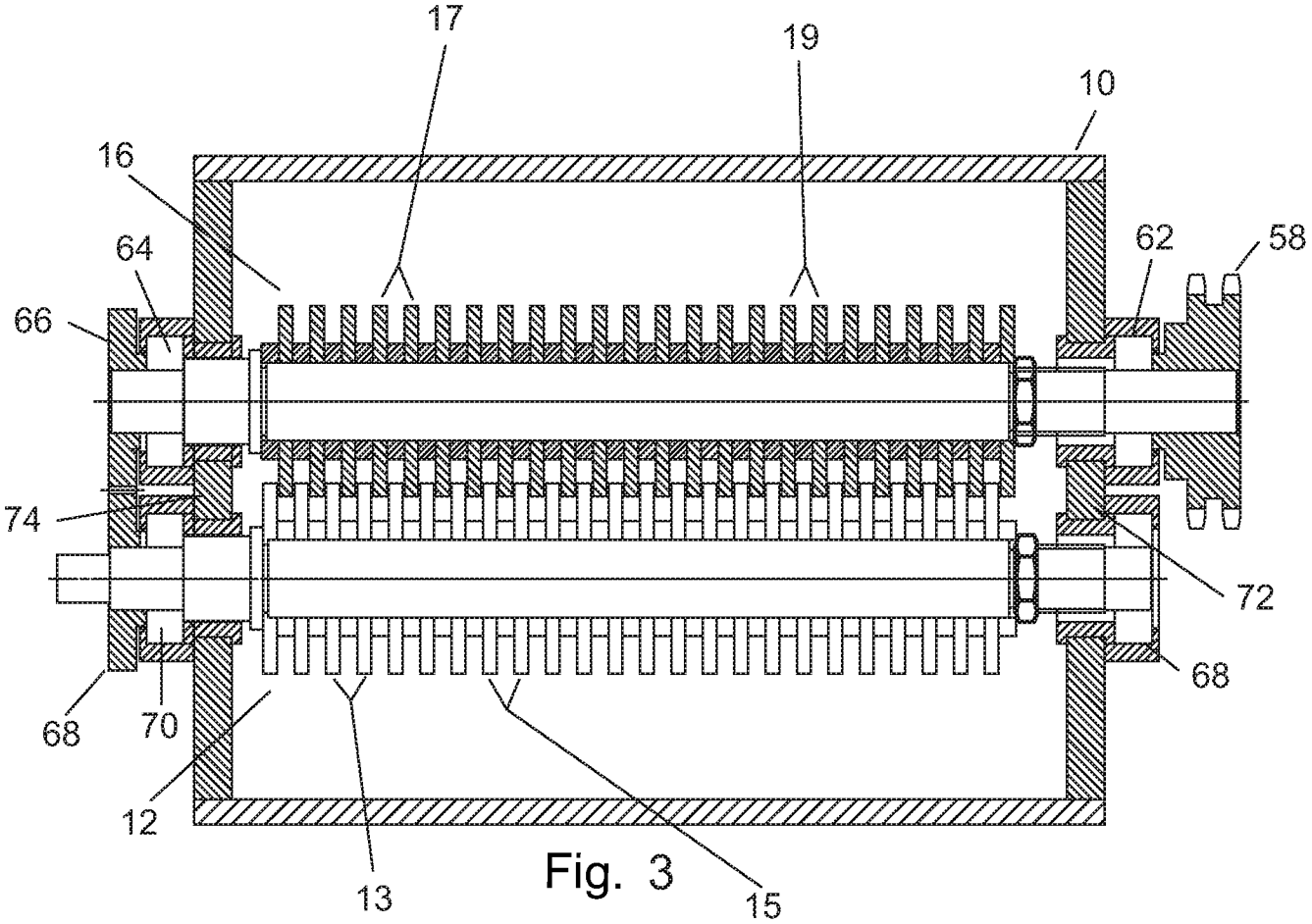
FIG. 3 is a top plane view of the crush box.
Figures 4, 5:
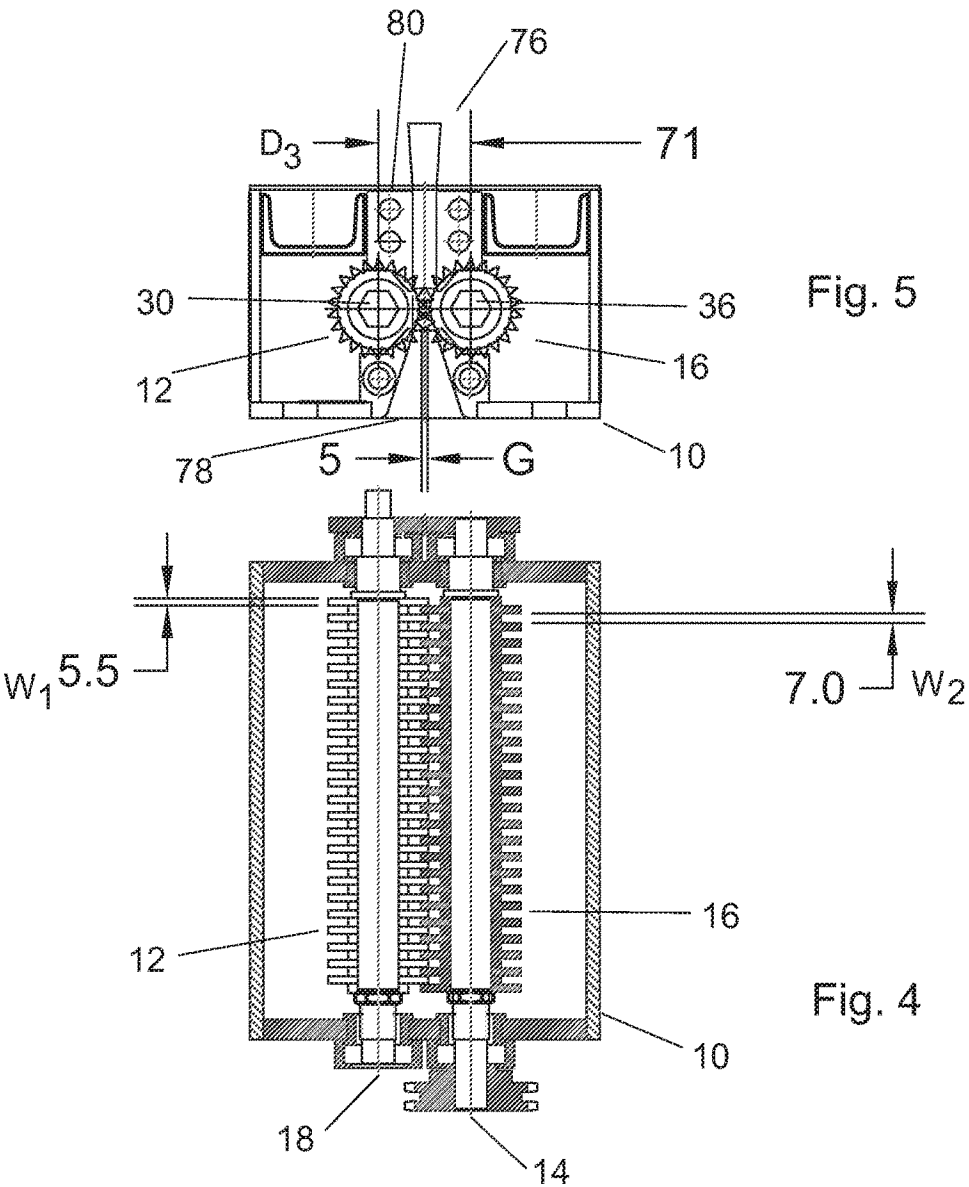
FIG. 4 is a top plane view of the crush box with dimensions.
FIG. 5 is an end view of the crush box.
Figure 6:
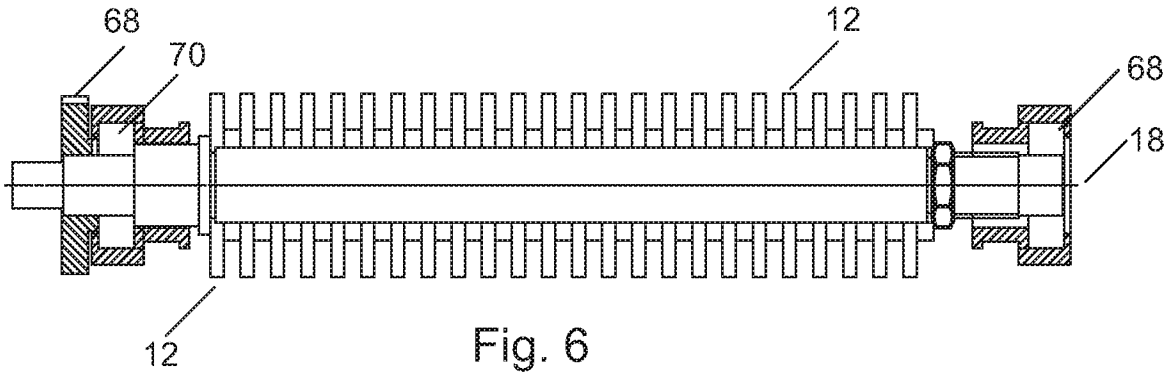
FIG. 6 is a side view of the first roller.
Figure 7:
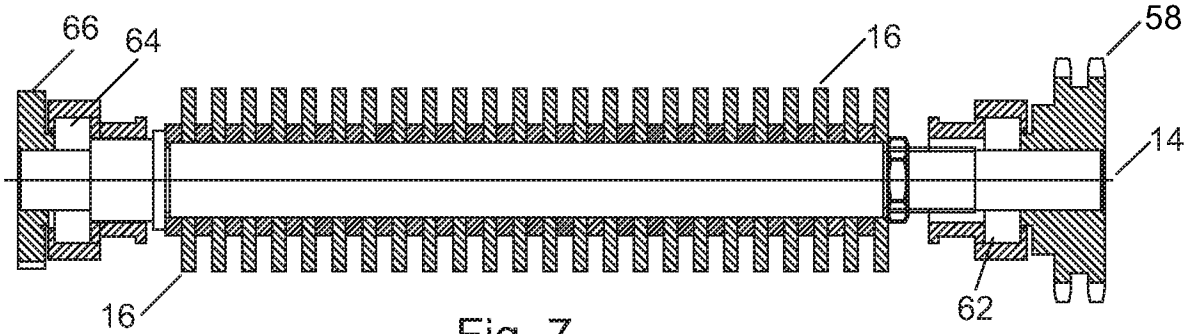
FIG. 7 is a side view of the second roller.
Figure 9:
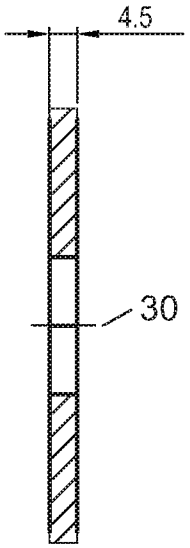
FIG. 9 is an end view of the teeth.
Figure 8:
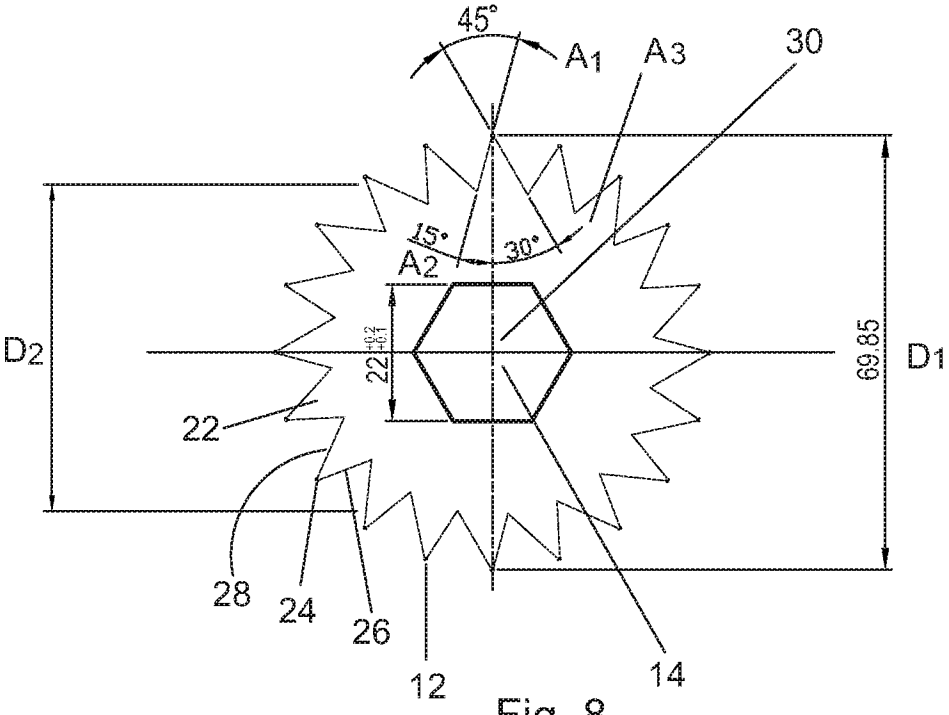
FIG. 8 is a side view of the teeth.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the Figures, set forth is an apparatus for destroying solid state drives (SSD). The apparatus employs a crushing box 10 having a first roller 12 with a first centrally disposed axle 14 spaced apart from a second roller 16 with a second centrally disposed axle 18. The first roller 12 and the second roller 16 are positioned to be counter-rotating with directional teeth. The entryway 76 to the crusher box 10 is located on an upper surface 102 of the housing. A pullout drawer 104 houses a wheel mounted receptacle 106 for use in capturing SSD's fed through the entryway 76 for destruction. An upper portion 108 of the drawer 104 is sloped to cause spent SSD's to fall within the wheel mounted receptacle 106. A control module 110 employs sensors to detect media feed jams with a controller to automatically reverse the fee to unjam the media. The control module 110 automatically powers off after 60 seconds of inactivity to conserve energy. RFI and EMI suppression minimize interference with local electronic equipment.

In a preferred embodiment the first roller 12 is defined by an outer diameter D1 of about 69.85 mm, an inner diameter D2 of about 50 mm, and a width W1 of about 5.5 mm. From the outer diameter D1 to the inner diameter D2 each tooth 22 has an insertion tip 24 with leading side surface 26 and a trailing side surface 28 formed at an angle A1 of about 45 degrees. The leading side surface 26 is formed at an angle A2 of about 15 degrees from a centrally disposed axle 30. The trailing side surface 28 is formed at an angle A3 of about 30 degrees from the centrally disposed axle 30. For drawing simplicity, each tooth of the twenty four 22 are formed of the same angles with a single tooth numbered to avoid drawing confusion. The first roller and the second roller 16 are interchangeable with the first roller 12. However, the second roller 16 is positioned in the crush box 10 in a reverse format wherein the leading side surface 26 of each tooth 22 is used to grab an SSD and pull the SSD between the rollers 12, 16 for destruction.

Each tooth on the first roller 12 having a width W1 is spaced apart from an adjoining tooth by width W2 of about 7 mm. The spacing is formed by positioning the first roller 12 centrally disposed axis 30 from the second roller 16 having a centrally disposed axis 36 by a distance D3 of about 71 mm which provides a gap G of about 5 mm between the inner diameters of each roller. The rollers 12 & 16 are constructed of high Rockwell hardness 62-64 HRc. The rollers 12 & 16 are preferably adjustable wherein the teeth are positioned to cause maximum cutting with a 61.5 mm center to center spacing having 8.3 mm penetration, as well as lesser cuttings of 63 mm having 6.8 mm penetration, 64.5 mm having 5.3 mm penetration, or 66 mm center to center having a spacing between teeth of about 3.8 mm.

The control module 110 is coupled to a variable frequency drive and proportional integral derivative ("VFD-PID") controller 111 for rotation of the first roller 12 in a clockwise direction. The first roller 12 rotatably coupled to the second roller 16 in a counter-clockwise direction by the spur gears 66 and 68. The VFD-PID controller 111 is used to vary the speed of the electric motor 50 by changing the frequency of the electric power going to the motor. Conventional power operates at 60 hertz (Hz) and the motors operated at 900, 1,200, 1,800 rpm, or 3,600 rpm depending on how the motor is wound. In the case of the HTP-SSD, operating on single phase power connected to 4-pole, 1.1 kw motor by a single-phase in and 3-phase out VFD.

The VFD-PID controller 111 provides frequency setting and motor switching (i.e. 50 Hz, 60 Hz, Acceleration, Deceleration, Forward, Reverse, etc.). Incorporated into the VFD is a PID feedback signal that allows for various target values to be set. One of the parameters is "Over-torque Detection". When the output current exceeds over-torque detection level and exceeds over-torque detection time, the over-torque detection will flag the system. The warning will be off only until the output current is smaller than 5% of the over-torque detection level. This "Over-torque Detection" function prevents jams and allows the user to recover from a jam if one occur wherein Torque Calculation t=9550*p/n, p is power in kw, n is rpm (1800*gear ration=170:1), t unit is NM.

$$t=9550*1.1/(1800/170)=992 \text{ NM}$$

The interlacing tooth discs 30 penetrates and shears, leaving an imprint indention pattern on the SSDs. The roller assembly is made up of individually stacked discs 30 rotated every 60 degrees to create a helical pattern. The hardened discs material has a maximum yield strength to withstand ultimate stresses beyond its typical use, but in case of tooth facture, the granularity of the interlacing teeth compensates for missing tooth tips. Even much so, the rollers are interchangeable, and each disc can be replaced with minimal effort.

The first roller 12 and the second roller 16 operate jointly to pull an SSD between the teeth 22 with a distinctive waffle pattern cut into the SSD. The destroyed SSD remain intact so that they can be counted manually or otherwise verified. The SSD can be 1.8" or 2.5" drives using either plastic or metal cases.

The instant invention operates using identifiable geometry differences (i.e. no spring tension, cam linkages, spring pistons, etc.). The counter rotating teeth rollers are interchangeable for ease of service and provides interlacing spacing for imprint granularity (2 mm×2 mm or less). The drive mechanism operates using a gear electric motor 50, coupled to two spur gears 66 & 68, and controlled by the variable frequency drive—proportional-integral-derivative controller 111, which deforms and imprints a pattern on SSD drives at a high rate of speed using the PID constant feedback signal. (<3 seconds per 2.5-inch SSDs).

The rollers are operated by a electric motor 50 that is coupled to a gear box 52. The electric motor operates a 3600 rpm's drawing 15 amps at 100 volts or 7.5 amps at 220 volts. The gear box 52 reduces the speed providing an increase in torque for rotation of a gear 54 causing rotation of a chain 56 that is attached to a sprocket 58 of the second roller 16. The sprocket 58 provides a direct rotation of the roller which is held in position by frontal bearings 60 and rear bearing 62. The end 64 of the second roller 16 includes driver gear 66 that meshes with receipt gear 68 causing rotation of the first roller 12. The first roller having frontal bearings 68 and rear bearing 70. Forward and rearward adjustment blocks 72 and 74 provide an adjustable spacing between the first roller 12 and the second roller 16.

The crusher box 10 includes an entry 76 and exit 78. Preferably the entry 76 includes alignment pins 80 located on either side of the entry 76 to maintain an SSD placed into the entry to assure gravity will assist in aligning the SSD between the rollers 12 and 16. The angles on the frontal side surface of the teeth are positioned to assure that the teeth will grab the SSD allowing assurance that the media will be pulled into the crusher box.

Figure 11:
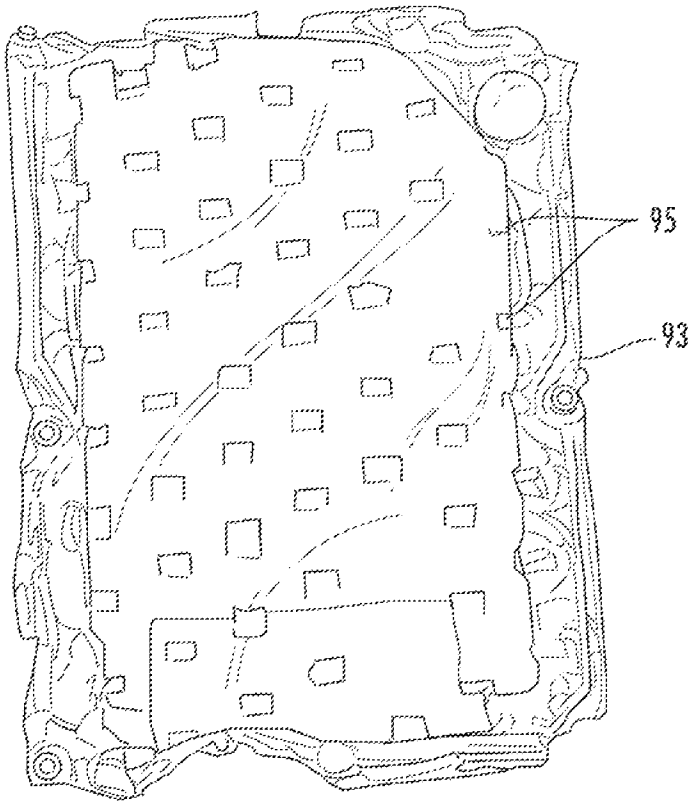
FIG. 11 is a plane side view of a destroyed SSD.
Figure 10:
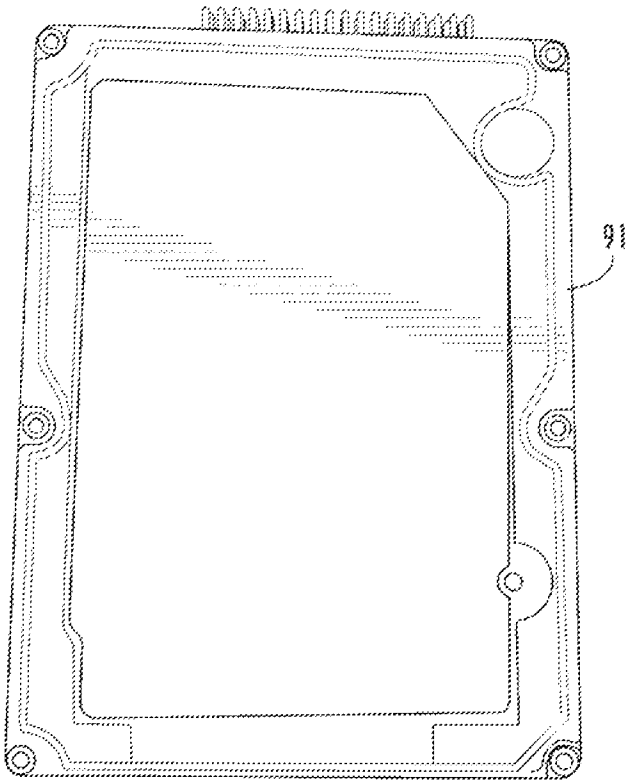
FIG. 10 is a plane side view of an SSD.
Figure 12:
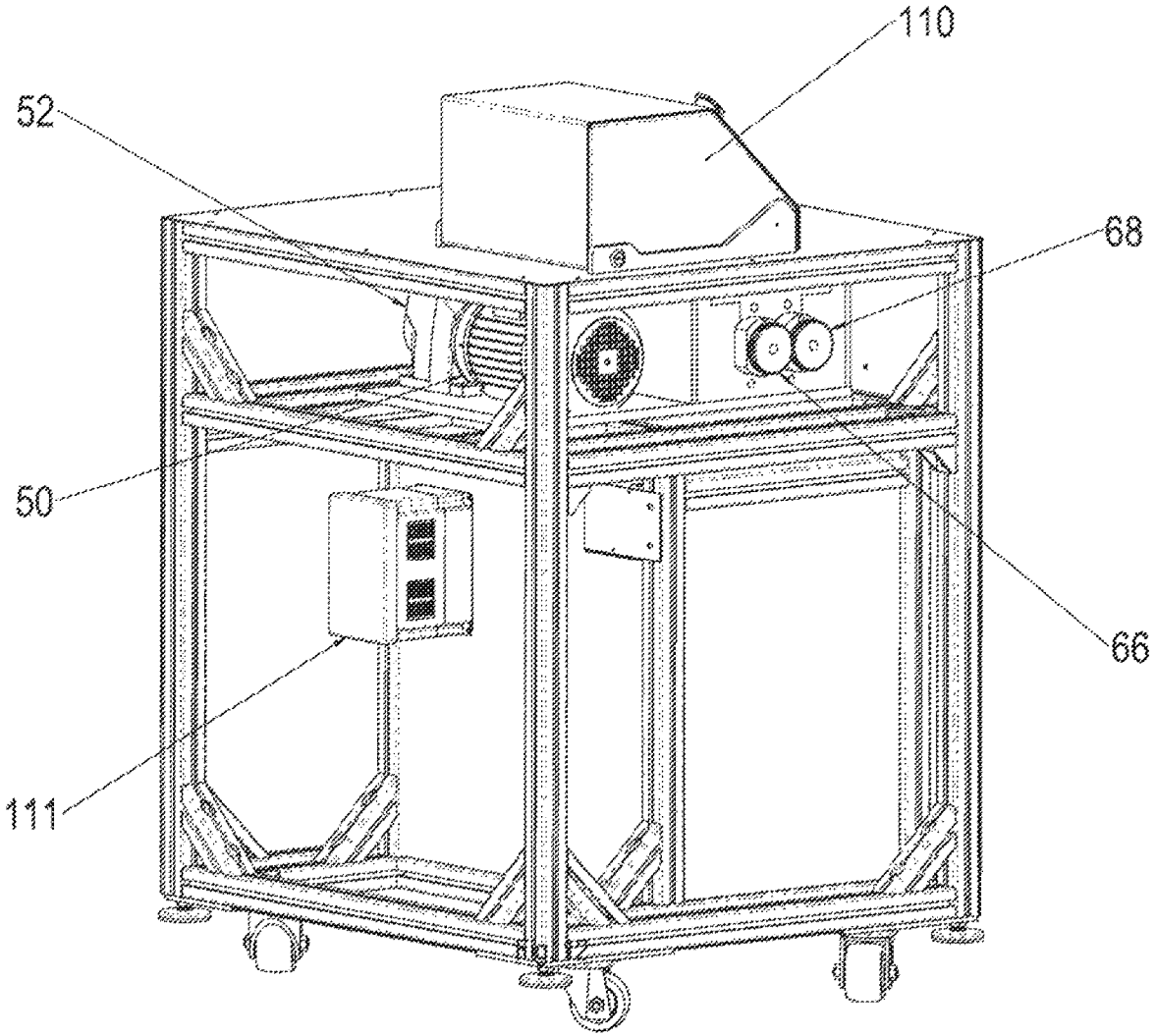
FIG. 12 is a rear prospective view of the SSD high speed destroyer.

FIG. 10 illustrates an SSD 91 that may have been destroyed through conventional demagnification or still operational. Without markings on the casing, the destruction of the electronic media can only be assumed. FIG. 11 illustrates an SSD that that been drawn through the rollers of the instant invention. The casing 93 has been permanently disfigured with a pattern of penetrations 95 that is easily recognized thereby providing visual verification that the particular SSD had been rendered inoperable.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed. The term "about" means, in general, the stated value plus or minus 5%.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An apparatus for destroying a solid state drive (SSD) through waffle pattern indentations to provide visual identification of SSD destruction, said apparatus comprising:

a crushing box housing a first roller rotatable in a clockwise direction around a first axis, and a second roller rotatable in a counter-clockwise direction around a second axis, said first axis spaced apart from said second axis, said first and second roller each having 24 rows of teeth constructed of Rockwell hardness of 62-64 HRc, each row of teeth further defined by 20 individual teeth each having a 5 mm width and a 45 degree tip with a side edge positioned at about 15 degrees, each said row of teeth spaced apart from an adjoining row by a gap of about 7 mm, said first and second rollers are constructed and arranged to instill a waffle pattern indentation in an SSD passing between said rollers;

an adjustable block positioning said first axis and said second axis in the spaced apart position, said adjustable block is configured to maintain spacing between said rollers, spacing selected from the group consisting of: 3.8 mm penetration of an SSD when said first and second roller axis is spaced apart by 66 mm, 5.3 mm penetration of an SSD when said first and second roller axis is spaced apart by 64.5 mm, 6.8 mm penetration of an SSD when said first and second roller axis is spaced apart by 63 mm, or 8.3 mm penetration of an SSD when said first and second roller axis is spaced apart by 61.5 mm;

a drive mechanism coupled to a gear motor constructed and arranged to pass at least 720 SSD's per hour between said first and second roller, said drive mechanism including a variable frequency drive unit with a proportional integral derivative controller (VFD-PID), said VFD providing PID feedback signal for detecting an over-torque condition; wherein an allowable torque (t) determined by:

$$t=9950*p/n(1800*\text{gear ratio})$$

t is in NM, p is in kw, and n is rpm's; said VFD reverses rotation of said rollers when the over-torque condition is detected;

wherein an SSD inserted into said crushing box is drawn between said first and second roller whereby said rollers impart a waffle pattern to permanently disfigure an SSD thereby providing visual verification that the SSD had been rendered inoperable.

* * * * *